United States Patent [19]

Darvin

[11] 4,190,959

[45] Mar. 4, 1980

[54] FOOT MEASURING DEVICE

[76] Inventor: Herbert S. Darvin, 203 Oakwynne Rd., Broomall, Pa. 19008

[21] Appl. No.: 945,632

[22] Filed: Sep. 25, 1978

[51] Int. Cl.[2] ..... A43D 1/00

[52] U.S. Cl. ..... 33/3 B

[58] Field of Search ..... 33/3 B, 3 R, 3 C, 3 A, 33/143 L

[56] References Cited

U.S. PATENT DOCUMENTS

| | | | |
|---|---|---|---|
| 2,251,825 | 8/1941 | Fitzpatrick et al. | 33/3 B |
| 3,360,862 | 1/1968 | Darvin | 33/3 C |
| 3,579,837 | 5/1971 | Soriano | 33/3 B |

*Primary Examiner*—Willis Little

[57] ABSTRACT

A device for measuring and exhibiting the length and width of the human foot which comprises a first movable member adapted to be placed in contact with the end of a foot and a second movable member adapted to be placed in contact with the side of the foot. The device also includes an alpha-numeric display means which is adapted to exhibit at a single location the various lengths and widths of a foot and means responsive to the placement of the movable members for enabling the exhibition in the display means of the specific length and width of the foot measured.

3 Claims, 5 Drawing Figures

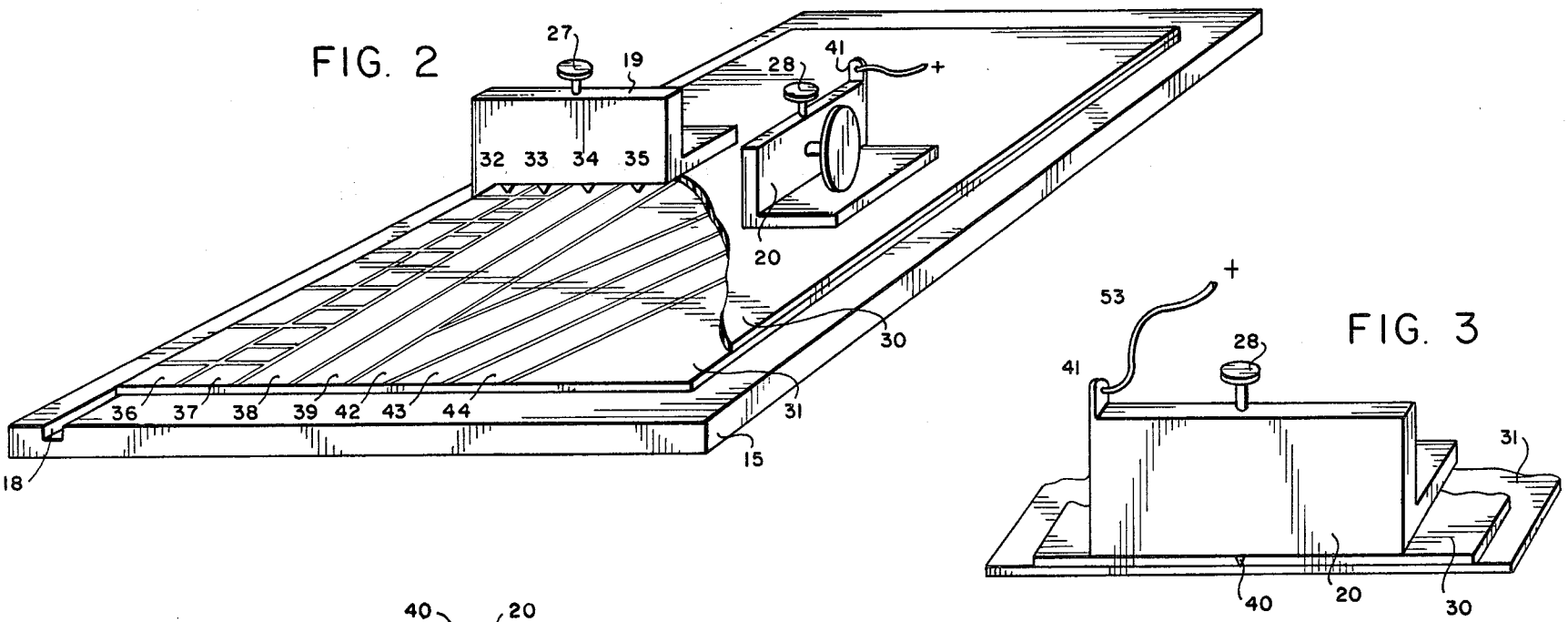
FIG. 2
FIG. 3
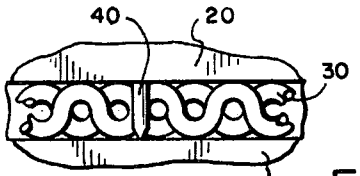
FIG. 3a

FOOT MEASURING DEVICE

This invention relates to a foot measuring device and more particularly is directed to an eletronic unit for use in measuring foot sizes and indicating the size measured by means of an electronic alpha-numeric display system, this is an aid in fitting and merchandising proper size shoes.

Several devices are available for measuring the length and width of a human foot for the purpose of fitting and merchandising shoes. However, the applicant is unaware of any which are as simple in construction and application while at the same time as accurate in measurement. All known devices are more complex in construction or application, or less accurate in measurement of the human foot.

The present invention provides a novel foot measuring devices which will both accurately measure the length and width of a human foot and simultaneously give a clear and concise visual display of the size measured to both the customer and the salesman. The unit is electrically powered and is operated by the salesman or the customer, manually bringing length and width slides into contact with the end and side of the foot thereby actuating an electronic alpha-numeric display panel which will give both the customer and salesman a visual display of the size measured.

It is therefore the primary object of the present invention to provide a novel foot measuring device. Another object of the present invention is to provide an electrically operated foot measuring device for use in fitting shoes.

Another object of the present invention is to provide a foot measuring device for giving a clear and concise visual indication of both the length and width of a human foot, by means of an electronic alpha-numeric display panel.

Another object of the present invention is to provide a unit which is simple in construction and operation and may be produced and sold at a reasonable price.

These and other objects and advantages of the invention will become more apparent upon reference to the following specifications, claims and appended drawings wherein:

FIG. 2 is a perspective view which illustrates the moving elements, electrical contacts and insulating covering incorporated in the unit of FIG. 1.

FIG. 3 is a perspective view of the width indicating slide which illustrates the novel method of completing circuits by means of contact pins which are allowed to pass through the insulating covering to make contact with the electrical contacts of the printed circuit board.

FIG. 3*a* shows the contact pin passing through the insulating cover to contact the printed circuit board.

Figure 4:
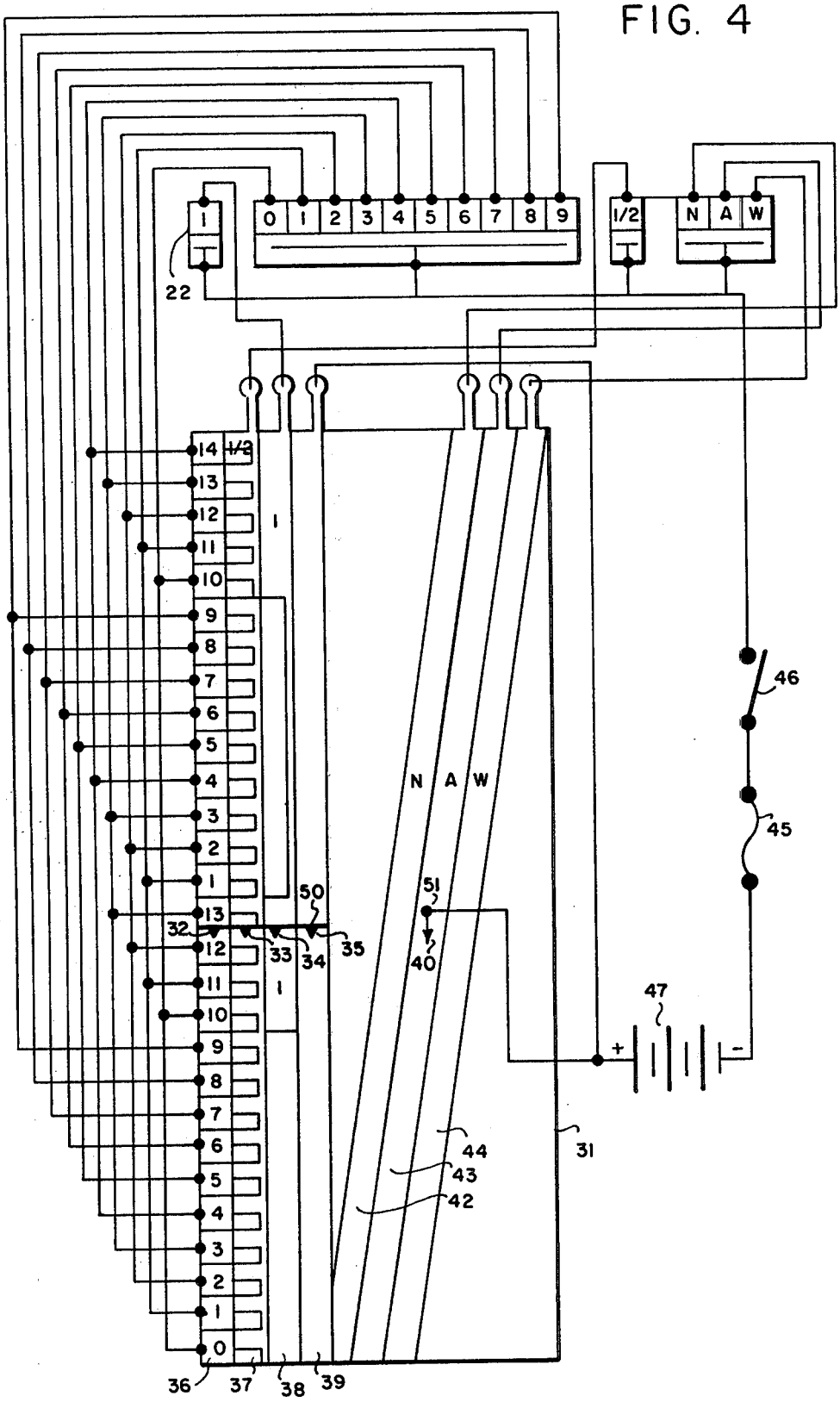

FIG. 4 is a plan view of the printed circuit board containing the length and width electrical contacts, and a schematic diagram of the associated circuitry between it and the alpha-numeric display panel. Also illustrated is an example of a completed circuit for one length and width measurement.

Figure 1:
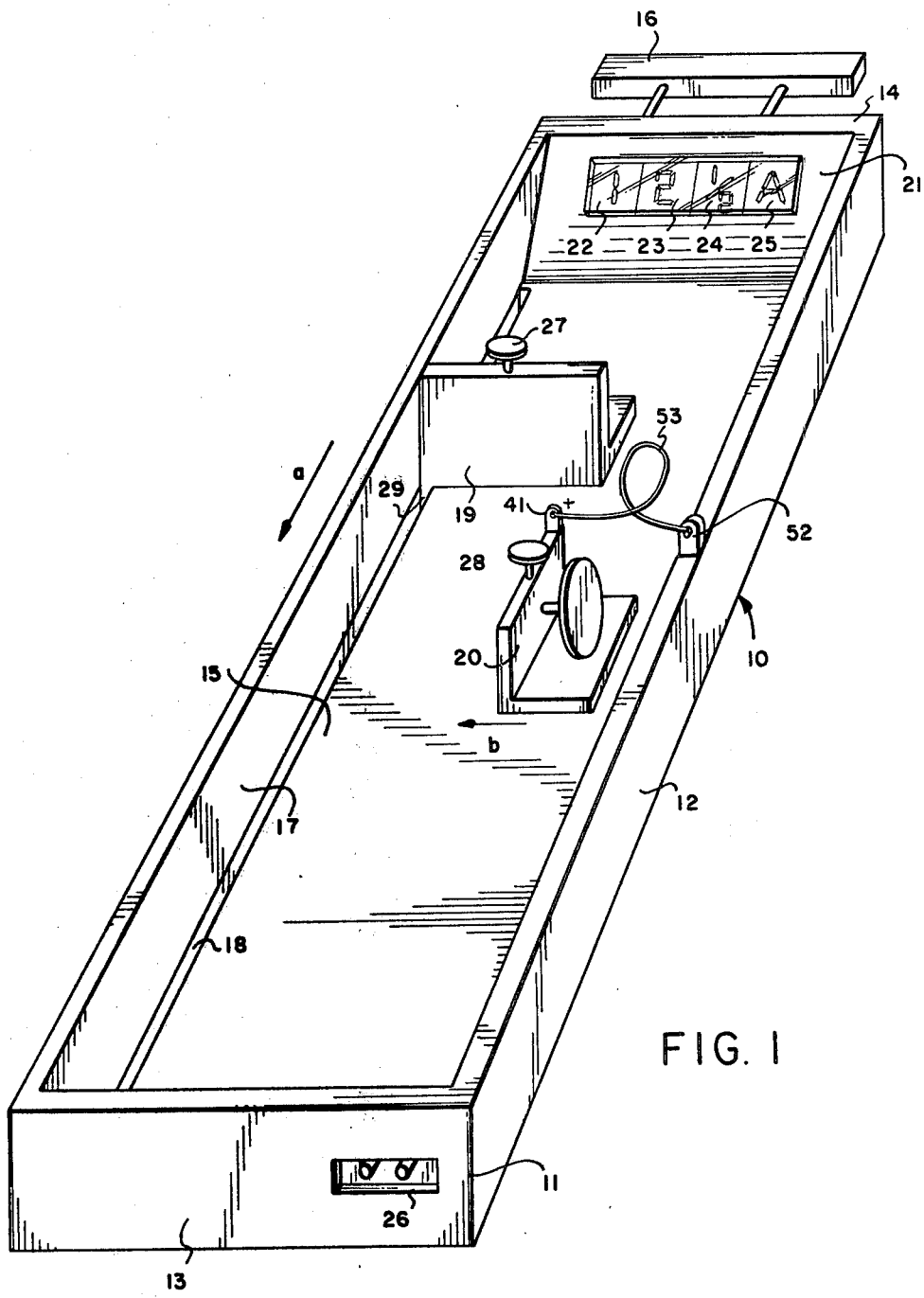
FIG. 1 shows in perspective, a preferred embodiment of the novel foot measuring device according to the invention.

Referring to the drawings, FIG. 1 shows a preferred embodiment of the foot measuring device of the present invention generally indicated at 10, comprising a casing 11 including side walls 12, front end wall 13, rear end wall 14, cover plate 15, and carrying handle 16. As indicated in the drawing, the casing 11 may be formed with an integral cover plate 15, side walls 12, front end wall 13 and rear end wall 14, to provide a housing for the measuring device.

The front end wall 13 serves as a horizontal abutment which provides a rest for the heel of the foot being measured and also provides the datum line from which the length measurement is taken. The left side wall 17 serves as a vertical abutment which provides a rest for the side of the foot being measured and also provides the datum line from which the width measurement is taken.

Integral to the cover plate 15 is a length indicator slide locating groove 18 which locates and retains the length indicator slide 19 by means of the length indicator slide retainer bar 29 which slides freely in the groove. Also resting on the cover plate 15 is the width indicator slide 20.

Generally indicated at 21 is an alpha-numeric display panel having individual displays of sufficient size and brightness to make them clearly and concisely visible to both the customer being fitted and the shoe salesman. This panel is to operate simultaneous with the placement of the length indicator slide 19 and width indicator slide 20.

The alpha-numeric displays indicated at 22, 23, 24, and 25 may be any of a number of commercially available types such as light emitting diodes (LED), liquid crystal digital (LCD), projected image or others. The prime requirement of the individual display being that it be capable of showing a multiple display in a single window of sufficient size and clarity to make it easily seen by both the customer and the shoe salesman.

In the preferred embodiment of the alpha-numeric display panel as shown at 21, individual display 22 is capable of displaying a 1. The individual display at 23 is capable of displaying any number from 0 through 9. The individual display at 24 is capable of displaying a ½. The individual display at 25 is capable of displaying the letters N, A, and W, for width measurements of narrow, average and wide.

As an example, the measured foot size of 12½ wide would be displayed as follows: display 22 would show a 1; display 23 would show a 2; display 24 would show a ½; display 25 would show a W. The measured size of 3 narrow would be displayed as follows: display 22 would show no display; display 23 would show a 3; display 24 would show no display; display 25 would show an N.

The preferred embodiment is constructed to be operated at low voltage, using small rechargeable batteries as a power source. Shown at 26 is a plug receptacle arranged to accept the plug of a battery re-charger.

In operation the preferred embodiment would operate as follows: the customer whose foot size is to be measured is seated on a chair, or may stand, in front of the foot measuring device. He then places either foot on the cover plate 15, bringing his heel into contact with the horizontal abutment 13 and the side of his foot into contact with the vertical abutment 17. The shoe salesman then slides the length indicating slide 19 into contact with the end of the customer's foot and presses length contact button 27. Both the customer and the salesman may then read the length measurement indicated on the display panel at 21. The shoe salesman then slides the width indicating slide 20 into contact with the widest part of the ball of the customer's foot and presses width contact button 28. Both the customer and the salesman may then read the width measurement indicated on the display panel at 21.

FIG. 2 is a perspective view which illustrates the moving elements and electrical contacts incorporated in the unit of FIG. 1 generally shown at 10. The view is of the cover plate 15 having a portion of its insulating covering 30 removed to expose the printed circuit board 31.

In both FIG. 2 and FIG. 1 is a length indicating slide 19 which is comprised of the following parts that are assembled to it: a length contact button 27 and four length slide contact pins at 32, 33, 34, and 35.

In operation the length indicating slide 19 is manually moved down, in the direction of arrow "a" in FIG. 1, until it makes contact with the foot being measured. The length contact button 27 is then pressed down causing the length slide contact pins at 32, 33, 34, and 35, which are normally in a retracted position, to be pushed out to make contact with the printed circuit board 31. The printed circuit board 31 has four length size contact tracks; 36 is the full length size track which connects with and activates the individual display 23 in FIG. 1; 37 is the ½ size track which connect with and activates the individual display at 24 in FIG. 1; 38 is the second decade track which connects with and activates the number 1 in the individual display 22 in FIG. 1; 39 is the power supply track which is connected to the positive side of the unit's power supply. The four length slide contact pins 32, 33, 34 and 35 are connected electrically one to the other such that the power picked up from the power track 39 is conducted through all of the length slide contact pins 32, 33, 34 and 35, thereby completing circuits through the printed circuit board 31 and the alpha-numeric display panel 21 in FIG. 1.

FIG. 3 is a perspective view of the width indicator slide 20 incorporated in the unit of FIG. 1 generally shown at 10. The width indicating slide 20 is comprised of the following parts that are assembled to it: a width contact button 28; a single width slide contact pin 40; a width slide electrical contact 41 and a power cable 53.

Once the length measurement is completed, the width measurement is accomplished as follows: the width indicating slide 20 is manually moved from right to left in the direction of arrow "b" in FIG. 1, until it makes contact with the widest part of the ball of the foot being measured. The center line of the width indicating slide being placed in the same plane as the center line of the metatarsal bone of the foot being measured. The width contact button 28 is then pressed down causing the width slide contact pin 40 in FIG. 3, which is normally in a retracted position, to be pushed out to make contact with the printed circuit board 31. The right side of printed circuit board 31 is comprised of three width size tracks; 42 is the narrow width size track which connects with and activates the "N" in display 25, FIG. 1; 43 is the average width size track which connects with and activates the "A" in display 25, FIG. 1; 44 is the wide size track which connects with and activates the "W" in display 25, FIG. 1. The power is supplied to the width slide contact pin 40 through a direct connection to the width slide electrical contact 41, which, in turn, is connected to the positive side of the unit's power supply.

View "A" is a greatly magnified view taken from FIG. 3 which illustrates the function of the insulating covering 30 in relation to the function of the width slide contact pin 40, as well as the length slide contact pins at 32,33,34 and 35. The insulating covering 30 is made from a heavy gauge, loose mesh, strong, abrasion resistant, electrically insulating material such as nylon or rayon. Its purpose is to provide a covering for the printed circuit board 31, electrically insulate the printed circuit board 31 from outside contact and at the same time allow the width slide contact pin 40 and length slide contact pins 32,33,34 and 35 to pass through it to make contact with the printed circuit board 31. The width slide contact pin 40 and length slide contact pins 32,33,34 and 35 shall be constructed in such a way as to allow them to pass through the insulating covering 30 without breaking or causing appreciable damage to the material fibers. FIG. 3*a* shows the contact pin 40 passing through the insulating covering 30 to make physical and electrical contact with the printed circuit board 31. FIG. 4 shows a plan view of the printed circuit board 31 in FIG. 2 and a schematic diagram of the associated circuitry between it and the alpha-numeric display panel as shown at 21 in FIG. 1. The size tracks at 36, 37, 38, 42, 43, and 44 are labeled in accordance with the foot size measurements to which they correspond. Although the schematic of the alpha-numeric display shows multiple display windows for displays 23 and 25, the actual displays are of the type which makes all displays in a single window as shown in FIG. 1.

The printed circuit board 31 is made of an electrical conducting material laminated to a matrix of an insulating material, the pin contacts thus being insulated from one another, where this is necessary.

The length and width contact points as illustrated in FIG. 4 are dimensioned and spaced in accordance with standard shoe length and width dimensions. It should be noted that there is a direct relationship between the width and length dimensions in the measurement of foot sizes. The dimension of a "D" width, for example, being of a greater absolute dimension for a length size 10 than for a length size 6. This fact necessitates the type of construction of the width indicating portion of the printed circuit board shown on FIG. 4. The width scale is constructed and positioned such that it is referenced from both the length datum 13 and the width datum 17 in FIG. 1, and such that each width dimension bares the required relationship to its corresponding length measurement. Although the preferred embodiment as shown in FIG. 4, illustrates a width scale designation of narrow, average, and wide, it is obvious that the scale could be constructed to indicate width in the more precise terms of A,B,C,D, and E or some other accepted scale.

As illustrated in FIG. 4, the unit contains a fused 45, and switched 46, power supply 47. The power supply may be internal to the unit in the form of rechargeable batteries or external to the unit in the form of a low voltage electrical connection.

Also illustrated in FIG. 4 is an example of how a circuit is completed during operation of the unit. As generally shown at 50, length indicator pin 35 is making contact with the power supply track 39 and conducting current to length indicator pins 32,33, and 34. Length indicator pin 32 is making contact with full size contact no. 12 in track 36 thereby completing the circuit through and causing the display of the number 2 in the individual display 23. Length indicator pin 33 is making contact with a ½ contact in track 37 thereby completing the circuit through and causing the display of the fraction ½ in individual display 24. Length indicator pin 34 is making contact with the number 1 contact in track 38 thereby completing the circuit through and causing the display of the number 1 in individual display 22. As generally shown at 51, width indicator pin 40 which is supplied current directly from the unit's power source 47, is making contact with the "average" width contact, track 43 thereby completing the circuit through and causing the display of the letter "A" in individual display 25. Thus with the length indicator slide positioned as illustrated generally at 50 and the width indicator slide at 51, the foot size of 12½ A(average) is displayed on the alpha-numeric display panel 21 in FIG. 1.

The purpose of the present invention is to provide a novel foot measuring device for use in the fitting of shoes. The device is of a simplified design in relation to known similar devices. It is electrically powered by batteries or from an external low voltage power source. The unit is very easily operated and gives an instantaneous visual display of the length and width of the foot being measured. The present invention will therefore provide a novel means of giving a true and accurate foot measurement while at the same time giving a clear and concise visual display of the size measured.

Numerous modifications may be made without departing from the spirit or scope of the present invention. It will be apparent that various modifications may be incorporated into the layout of the printed circuit board, its associated circuitry, or the mechanical portion of the unit. Likewise, the numeric displays may be placed in a number of patterns.

The present invention may be embodied in other specific forms without departing from the spirit of the invention and no limitation should be assumed other than those specifically set forth in the claims, the present embodiments being considered in all respects as illustrative and not restrictive.

What is claimed and desired to be secured by United States Letters Patent is:

1. An electronic device for measuring and exhibiting the length and width of a human foot, said device comprising, a base, a first slidable member movable on said base and adapted to be placed in contact with the end of a foot supported by said base, a second slidable member movable on said base and adapted to be placed in contact with the side of said foot, said slidable members being independently slidable relative to each other, a first reference member located at one end of said base for positioning of the heel and a second reference member located on said base perpendicular to the first reference member for positioning of one side of the foot, said reference members establishing the reference planes for the measurement of the foot, electronic means responsive to the placement of said slidable members, and changeable character alpha-numeric display means responsive to said electronic means adapted to exhibit at a single location the various lengths and widths of a foot.

2. The invention in claim 1 wherein said means responsive to the placement of said slidable members comprises a plurality of electrically conductive contacts placed in a combinational pattern on said base, adjacent the path of said first and second slidable members, a nonconductive material covering said electrically conductive contacts, said first and second slidable members including pin contactors adapted to sense various combinations of said contacts in accordance with the position of said slidable members, said contacts being spaced in accordance with standard shoe size dimensions.

3. The invention of claim 2 wherein a portion of said electrically conductive contacts placed in a combinational pattern include a plurality of parallel electrically conductive strips which extend at an angle from the path of the first slidable member, the pin contactor of said second slidable member being adapted for selectively contacting one of said strips.

* * * * *